US006245726B1

(12) United States Patent
Cannon et al.

(10) Patent No.: US 6,245,726 B1
(45) **Date of Patent: *Jun. 12, 2001**

(54) SOYBEAN BASED TRANSFORMER OIL AND TRANSMISSION LINE FLUID

(75) Inventors: Glenn S. Cannon, Waverly; Lou A. T. Honary, Cedar Falls, both of IA (US)

(73) Assignee: Waverly Light and Power, Waverly, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/370,440

(22) Filed: Aug. 9, 1999

Related U.S. Application Data

(63) Continuation of application No. 09/075,963, filed on May 11, 1998, now Pat. No. 5,958,851.

(51) Int. Cl.[7] ..... C10M 105/32; H01B 3/20

(52) U.S. Cl. ..... 508/491; 508/578; 252/570; 252/579; 174/17 LF; 361/327

(58) Field of Search ..... 508/491

(56) References Cited

U.S. PATENT DOCUMENTS

| | | | | |
|---|---|---|---|---|
| 1,776,309 | | 1/1929 | Clarke | 252/407 |
| 3,928,705 | | 12/1975 | Loft et al. | 252/567 |
| 4,421,663 | | 12/1983 | Embree et al. | 252/74 |
| 4,536,331 | | 8/1985 | Shedigian | 252/579 |
| 4,543,207 | * | 9/1985 | Sato et al. | 252/570 |
| 4,642,730 | | 2/1987 | Sato et al. | 252/570 |
| 4,734,824 | | 3/1988 | Sato et al. | 361/315 |
| 4,791,240 | | 12/1988 | Marin et al. | 252/570 |
| 4,812,262 | | 3/1989 | Shinzawa et al. | 252/567 |
| 4,931,900 | | 6/1990 | Lobo et al. | 252/579 |
| 5,077,069 | | 12/1991 | Chang et al. | 426/330.6 |
| 5,413,725 | * | 5/1995 | Lal et al. | 508/491 |
| 5,451,334 | | 9/1995 | Bongardt et al. | 508/307 |
| 5,595,966 | | 1/1997 | Rees et al. | 508/591 |
| 5,766,517 | | 6/1998 | Goedde et al. | 252/570 |
| 5,958,851 | * | 9/1999 | Cannon et al. | 508/491 |

FOREIGN PATENT DOCUMENTS

| | | |
|---|---|---|
| 430045 | 6/1935 | (GB) . |
| 082936 | 4/1974 | (JP) . |
| WO 97/22977 | 6/1997 | (WO) . |
| WO 97/40698 | 11/1997 | (WO) . |

OTHER PUBLICATIONS

University Of Northern Iowa, New Service, Office of Public Relations, Cedar Falls, Iowa 50614–0017: Pub. Jul. 9, 1997; 2 pages.

Handbook of Soy Oil Porcessing and Utilization; D. R. Erickson, et al. editors published by American Soybean Association and American Chemist Society, copyright 1980; pp. 131–143 and 193–204.

Honary, Lou A. T.; "An Investigation of the Use of Soybean Oil in Hydraulic Systems", 1996, pp. 41–47, University of Northern Iowa, Cedar Falls, IA 50614–0178, USA.

Nichicon Capacitor LTD, JP 61 042816, Derwent Publications, Ltd., London, GB, Class A85, AN 1986–097634, Abstract.

* cited by examiner

*Primary Examiner*—Ellen M. McAvoy
(74) *Attorney, Agent, or Firm*—Zarley, McKee, Thomte, Voorhees & Sease

(57) ABSTRACT

A soybean oil based electrically insulating fluid with a high flash point and a high fire point. The base oil is hydrogenated to produce maximum possible stability of the soybean oil, and can be winterized to remove crystallized fats and improve the pour point of the base oil without the necessity of heating the oil. The base oil can also be combined with an additive package containing materials specifically designed for improved pour point, improved cooling properties, and improved dielectric stability.

94 Claims, No Drawings

SOYBEAN BASED TRANSFORMER OIL AND TRANSMISSION LINE FLUID

This application is a continuation of application Ser. No. 09/075,963, filed May 11, 1998, and now U.S. Pat. No. 5,958,851.

BACKGROUND OF THE INVENTION

1. Field of the Invention

The present invention relates to fluids that are used with electrical equipment and transmission components, and in particular, to fluids used for electrical insulation and/or heat dissipation in electrical components such as, for example, electrical transformers and electrical transmission lines.

2. Problems in the Art

The components that are used to generate and transfer electrical energy to end users, such as homeowners or businesses, are well known in the art. Electrical power producers generally generate electrical power at very high initial voltages. Handling of such high voltages requires substantial electrical insulation. It requires control of heat that is generated from the transmission of the electrical energy and maintenance of its dielectric properties.

It has been found that certain fluids have high insulating and heat dissipation properties. These fluids are used with such electrical components as transformers and fluid filled transmission lines. One particular problem, even with such fluids, is that over time and with substantial exposure to high voltage electricity, the beneficial characteristics of such fluids, such as insulating and/or heat dissipation properties, degrade.

Conventionally, petroleum based fluids are used for these types of applications. It must be appreciated that such fluids have certain properties that allow them to function satisfactorily. They must be electrically insulating and dissipate heat. They must resist break-down. Synthetic fluids are also in use. However, currently used fluids have several deficiencies or concerns.

Most of the current fluids are minimally biodegradable. They pose safety or contamination concerns. They can be toxic to humans and animals. Many electrical components holding such fluids are situated near water or waterways. Leakage or spills can cause serious damage to water and marine life. Leaks or spills on land can threaten ground water and contaminate soil.

Petroleum based products are non-renewable. The amount of fluid of this type in use is significant. For example, one 15 MVA transformer (approximately serves 2000 customers, both residential and commercial) requires on the order of 3600 gallons of electrically insulating fluid. One mile of fluid filled transmission cable (6 inch diameter) requires about 7000 gallons. There are approximately 20,000 miles of high-pressure fluid filled transmission cables (one type of the same) in the United States, most in larger cities and therefore most are near water or waterways.

As can be appreciated, significant amounts of resources, both time and money, are spent by electrical power companies, in designing and implementing plans and systems to deter leaks or spills and to monitor transformers and transmission cables of these types for leaks or spills. It is estimated such costs are in the millions of dollars in the United States. Additionally, substantial resources are expended in reporting leaks or spills, even minor, because of environmental rules and regulations with regard to at least petroleum based fluids. And, of course, the effect of leaks or spills can be very costly, as can remediation of the same.

Therefore, there have been attempts to look to new sources for such fluids, including vegetable oils. Such attempts would address both the environmental concerns as well as the issue of renewability of source. While synthetic fluids are somewhat renewable, they generally still present environmental concerns.

A similar problem exists with respect to petroleum or synthetic based lubricants. The idea of substituting vegetable oils as a substitute for petroleum-based industrial lubricants is not new. Furthermore, finite supply of petroleum based products plus concerns over environmental effects from spills/disposal of petroleum based lubricants has fueled interest in the use of vegetable oils as viable substitutes.

Efforts in use of vegetable oils as the base oil have focused upon less stringent uses such as hydraulic fluids, transmission fluids, and greases and not on the more severe automotive-type (engine) lubricants, or transformer cooling oils. The vast majority of these endeavors have utilized vegetable oils high in natural oleic acid levels such as safflower oil, canola and rapeseed oils. The reason for this focused research upon these high oleic acid level vegetable oils is the tendency of natural vegetable oils to destabilize in use absent the presence of a high level of oleic acid. Soybean oils have a relatively low level of oleic acid and have been uniformly rejected in practical application because of the tendency of soybean oil to solidify while in use within the environment of high temperatures.

There are several fundamental properties transformer oils, for example, require, most of which are contrary to the natural properties of vegetable oils. Those are oxidation stability, dielectric constant, pour point, sludge formation, and formation of acids. Of all the vegetable oils, such as rapeseed, canola and castor, commonly considered for industrial lubricants, soybean oil is the more unstable (oxidatively) because of its unsaturated nature. Additionally, it does not have the dielectric properties necessary to insulate.

The primary purpose of the types of fluid needed for electrical transformers and fluid-filled transmission lines, hereinafter referred to as electrically insulating fluid, is to maintain cooling properties and fluid characteristics while in use within the system so as to maintain appropriate temperature as well as dielectric strength on demand. The heat of the transformer unit, for example, can increase to high levels for extended periods of time which the fluid must be able to tolerate without losing its properties. Additionally, the operation of transformers and the process of heat dissipation at varied ambient temperatures subjects the fluid to constant stresses.

Some vegetable oil based electrically insulating fluids have found commercial success. These vegetable oil based fluids have often been of the more naturally stable seed oils. Specifically, oils naturally high in oleic acid content or low in linolenic content and in some cases low erucic acid have been used. Variations in temperature, in particular high temperature environments, are known to impact the ability of a vegetable oil based fluid to remain in the liquid state. As a result, this limited number of vegetable oils have been found to function with relative success.

Use of vegetable oil based electrically insulating fluids in the out-of-doors environment presents a much harsher challenge. To date, the success of such fluids has been very limited. Rapeseed and canola oil based fluids have been commercially offered, but questions remain as to the functionality. These questions include sufficiency of electrical insulating properties and oxidation problems. Also, since crops such as rapeseed and canola are grown mainly outside the United States, it is expensive to import and produce, which in turn increases the expense of making oils from them.

Because the above questions regarding rapeseed and canola oil exist, the same questions exist with respect to other less thermally stable oils such as soybean.

Soybean oil, because of its unsaturated nature, lacks desired oxidative stability for many industrial applications where continuous long-term heating takes place. In use, transformer and transmission line cooling oil must successfully operate not only to cool the components of the transformer and transmission line but also to not break down thus changing its dielectric constant. The key characteristics required for such fluid use are:

1. High oxidation stability:
a. long life and protection;
b. no oxidation materials; and
c. no changes in chemical properties.
2. Viscosity Characteristics:
a. low pour point for cold temperature service, particularly in cold temperature regions; and
b. high Viscosity Index for best viscosity under various operating temperatures.
3. Corrosion Inhibition Properties:
a. inhibits contaminants in the fluid;
b. inhibits water;
c. inhibits oxidation by-products; and
c. inhibits changes in the fatty acid (in the case of vegetable oils).
4. Seal, Polymer, Resin Compatibility:
a. with old and new seal materials; and
b. with resin and other insulating materials.

Another demand placed upon electrically insulating fluid is the requirement that it would maintain a certain degree of stability in terms of insulating properties despite some of the physical and chemical changes that take place during extended use.

Therefore, it is a primary object of the present invention to present a composition and method which improve over and/or solves the problems and deficiencies in the art. Further objects of the invention include the provision of a soybean oil based composition and method which:

a) can be substituted for existing electrically insulating fluids used in such electrical components as transformers and fluid filled transmission lines, but is more environmentally friendly and less toxic.
b) is more biodegradable than petroleum based or some synthetic based fluids.
c) has a renewable source.
d) meets the specifications and requirements typically recognized by the industry for such fluids and/or performs generally equivalently to existing fluids.
e) is relatively long-lasting and durable over a variety of operational and environmental conditions.
f) is economical to make, use, and maintain.

These and other objects, features, and advantages of the present invention will become more apparent with reference to the accompanying specification and claims.

SUMMARY OF THE INVENTION

The present invention relates to a soybean oil based electrically insulating fluid for use in electrical components that need such a fluid, such as for example, electrical transformers and fluid-filled electrical transmission cables or lines. A base oil made from soybean oil is chemically modified by at least partial hydrogenation. To achieve this result, the base oil is optimized, through the process of hydrogenation, to produce maximum possible stability of the soybean oil. This process is necessary for transformer equipment and transmission line applications. An antioxidant is added to the base oil.

The soybean-based oil of the present invention can utilize an additional step of winterization to remove crystallized fats and improve the pour point of the base oil without the necessity of heating the oil. An additive package for the present invention can be included which contains materials specifically designed for improving the properties of soybean oil for this application.

The combination of the processed soybean oil and additives thus produces an electrically insulating fluid that withstands the rigors of field use involving a wide range of temperatures.

According to the invention, an electrical component containing the soybean based oil described above is set forth. The soybean based oil, contrary to existing petroleum based or synthetic oils, is biodegradable and therefore safer relative to the environment and to living things. It also is based on a natural renewable resource.

DESCRIPTION OF THE PREFERRED EMBODIMENTS OF THE INVENTION

To assist in a better understanding of the invention, preferred embodiments of the present invention will be described below in detail. Examples will be set forth. To give concrete examples, the embodiments are discussed in the context of fluid used as the electrically insulating/cooling fluid in electrical transformers (electric utility transmission and distribution transformers) and fluid-filled electrical transmission cables or lines, such as are known in the art. This is not by way of limitation to the invention.

An electrically insulating fluid for transformers comprises crude soybean oil, made from commodity soybeans, which has been partially hydrogenated and winterized, combined with a thinning ester and antioxidant(s) to produce a fluid having a kinematic viscosity in the range of 20–40 cSt at 40θ C. The soybean oil comprises less than 95% by weight of the fluid and the fatty acid profile of the resulting electrically insulating fluid includes C24:0. The resulting oil has a viscosity preferably in the range of 25–50 cSt at 40° C. vs. prior art soybean based oil which are high viscosity functional lubricants having viscosity ranges of 2,000–2,500 cSt at 25° C.

Soybean oil based electrically insulating fluids according to the preferred embodiments of the invention were tested under exacting laboratory conditions and in field use. This analysis of soybean oil based electrically insulating fluid revealed two primary findings. First, the dielectric qualities associated with the fluid were comparable to those qualities associated with other vegetable oil based fluids or petroleum based fluids. Second, durability of the fluid was generally a consistent problem with and without the combination of various additives.

In addressing the issue of durability, it was determined that partially hydrogenated soybean oil presented optimal results in bench tests and with field results. Since the demands on the product called for its use in out-of-doors conditions, the soybean oil was winterized to aid its low temperature utility. The winterized, at least partially hydrogenated soybean oil was found to have superior characteristics both in durability and in dielectric property.

Another problem with the soybean oil was its naturally higher than desired viscosity, which was modified with the addition of soybean-based esters to develop the desired viscosity.

A myriad of additive products were tested in the analysis of soybean oil based electrically insulating fluids. The various bench tests and out-of-doors field tests performed on the alternative combinations of additives and soybean oils yielded a wide variety of data. The bench tests provided comparative data in the areas of viscosity, density, pour point, flash point, and acid value. The testing is discussed more fully below.

The process of partially hydrogenating soybean oil made from commodity soybeans is well known in the art. It is explained at the following reference: Handbook of Soy Oil Processing and Utilization (Editors: D R. Erickson, E H. Pryde, O. L. Brekke, T. L. Mountsk R. A. Falb), published by American Soybean Association and American Oil Chemists' Society, Copyright 1980, Third Printing 1985; see, for example, Hydrogenation Practices, Chapter 9; and Partially Hydrogenated-Winterized Soybean Oil, Chapter 12. This is incorporated by reference herein.

The amount of hydrogenation can vary. However, the amount can be such that the hydrogenation is about that of what is known in the art as maintaining liquidity of soybean oil (salad quality oil). This is a standard term in the art. The hydrogenation, as will be discussed further below, could alternatively be described as having an Iodine Value in the range of 100–120. This is a well-known test for amount of hydrogenation. The step of partial hydrogenation is used because it raises the oleic content of commodity soybean oil significantly. For example, conventional commodity soybean oil available from any number of sources generally has an oleic acid content of about 20%. Partial hydrogenation increases this to around 40%. Thus, this approaches the much higher natural oleic acid contents of such oils as rapeseed oil and canola oil.

Still further, it is better for the electrically insulating fluid to have a linolenic acid amount as low as possible. Conventional commodity soybean oil has a linolenic content of around 8%. Partial hydrogenation reduces this to around 3%.

Winterization is also a well-known processing step to those in the art. See also Handbook of Soy Oil Processing and Utilization, referenced above and incorporated by reference herein. Winterization is an optional step. It is useful in particular with electrically insulating fluids that will be used outside in extreme temperatures. The winterization can be so that the fluid does not react adversely down to lower temperatures. With addition of pour point depressants, temperatures as low as −25° C. can be obtained.

The thinning esters are also optional. They are beneficial because they allow the fluid to be customized for different needs of different users. Some users want or need an electrical insulating fluid with a lower viscosity. Others need a higher viscosity. The thinning esters can be methyl esters derived from soybeans. Therefore, they too would be biodegradable. The range of carbon chain length for such thinning esters can be preferably in the range of 16 to 18, if using a natural product. Other chain lengths will work. Those skilled in the art would be able to determine which methyl esters or other thinning agents would work and how much is needed for a certain application. Alternatives would be methyl esters derived from palm oil and coconut oil, for example, and perhaps alcohol, but alcohol may increase flash point, which is to be avoided because of the high temperatures that may be experienced in electrical transformers or transmission lines, for example.

An additive to the base partially hydrogenated oil is an antioxidant. This increases the durability and longevity of the fluid over the conditions experienced in a transformer or transmission line or analogous uses. The antioxidant used is—preferably tertiary butylhydroquinone (TBHQ). Others are possible. The essential characteristic of the antioxidant used is that its working mechanism is a free radical scavenger. It is believed that most, if not all, antioxidants used as food preservatives or associated with food uses would work, including those available in health food stores. Additional antioxidants can also be added. Here a quantity of citric acid was added. Still further, tocopherols were added, which are from soybeans, but are many times lost through soybean processing.

An alternative to using partially hydrogenated soybean oil for the base oil according to the invention would be to use soybean oil from genetically engineered soybeans that are high in oleic acid. Soybean oil made from such soybeans can be purchased from DuPont and Pioneer Hi-Bred International. Such soybeans are believed to have an oleic acid content at least on the order of 40%. They also are believed to have a linolenic acid content on the order of 3%.

Of the acids in the composition of soybean oil, oleic acid is the most important relative to use of such oil as an electrically insulating fluid. The higher the oleic acid content the better. It has been found that the lower the linolenic content, the better also. Of course, if the oleic content is raised, other acids must be reduced, and this can occur for linolenic acid when oleic is raised.

Test Results

Soybean oil in its natural form is oxidatively unstable and when used in a transformer and transmission line system it thickens up. In extreme cases the oil, if left in the system, will polymerize. The most common way to determine oxidative stability of vegetable oils has been the Active Oxygen Method (AOM). Recently, however, another method has been introduced using what is called the oxidative stability instrument (OSI). Table 1 following shows an example of data presented in the literature using each of these methods:

TABLE 1

Oxidation Stability Instrument used in determining Oxidation in Canola and Partially Hydrogenated Soybean Oil (ABIL conducted tests).

| Oil Type | Viscosity (cSt) | OSI Time |
|---|---|---|
| Canola w. Antioxidant | 38.77 | 39.18 |
| Canola w/o Antioxidant | 38.70 | 9.04 |
| Chemically Modified Soy Oil w. Antioxidant | 38.45 | 50.70 |
| Chemically Modified Soy Oil w/o Antioxidant | 36.47 | 31.30 |

It can be seen that the chemically modified soy oil with antioxidant, according to the invention, has a viscosity on the order of canola oil with antioxidant. A better but more expensive method to investigate stability of vegetable oils in industrial application such as transformer and transmission line cooling systems is the use of the ASTM D2271 hydraulic pump test. This is a time consuming (1000-hour) test which helps determine both the pump wear protection property as well as the stability of the test oil. In this test the stability of the test oil is determined by changes in its viscosity during the test. An oil that maintains its viscosity (changes little), after completion of this test, will perform better in long term use in electrical transformers and electrical fluid filled transmission lines.

Thousands of hours of bench testing of treated and untreated soybean oils and other vegetable oils have been performed. Table 2 shows a comparison of selected vegetable oils including a number of soybean oils as tested in the ASTM D2271 test at the University of Northern Iowa College of Natural Sciences, Ag-Based Industrial Lubricant (ABIL) research facility at 400 Technology Place, Waverly, Iowa 50677.

TABLE 2

Using ASTM D2271, 1000-hour at 79° C. pump tests, the stability of various vegetable oils were compared to determine suitability of soybean oil regarding stability

| Item # | Oil Type/ Description | Viscosity Initial | Viscosity Final | Viscosity % Change |
|---|---|---|---|---|
| 1 | Palm Oil | 41.78 | 54.75 | 31.0 |
| 2 | Cotton Oil | 37.94 | 56.23 | 48.2 |
| 3 | High Oleic Canola Oil (1) | 38.20 | 57.73 | 51.1 |
| 4 | High Oleic Canola Oil (2) | 39.50 | 56.70 | 43.5 |
| 5 | High Oleic Sunflower Oil | 37.83 | 53.87 | 42.4 |
| 6 | Ultra High Oleic Sunflower Oil | 40.46 | 56.69 | 40.1 |
| 7 | Crude Soy Oil (Hexane extracted) | 29.91 | 73.77 | 146.6 |
| 8 | Crude Soybean Oil (expelled) | 30.16 | 65.87 | 118.4 |
| 9 | Crude Soybean Oil (extruded/ expelled) | 30.93 | 65.18 | 110.7 |
| 10 | Low Linolenic Crude Soybean Oil | 31.33 | 70.89 | 126.3 |
| 11 | Bleached Soybean Oil (ASTM 2882-100 hr test) | 29.63 | 31.65 | 6.8* |
| 12 | Refined Soybean Oil (ASTM 2882-100 hr test) | 29.72 | 31.99 | 7.6* |
| 13 | Deodorized Soybean Oil (ASTM 2882-100 hr test) | 29.59 | 31.34 | 5.9* |

*Note: Items 11–13 were in a different ASTM test using a higher pressure setting (2000 psi) but a shorter test of 100 hrs and a temperature of 65θ C.

Next, effort was focused on chemical modification of soybean oil as a means of increasing its oxidative stability. This led to the identification of one of the most stable commercially available, chemically modified soybean oils. This oil is a soybean oil which is partially hydrogenated. When combined with two antioxidants, citric acid and tertiary butylhydroquinone (TBHQ), the oil showed to perform significantly more stable than other soybean oils. In the preferred embodiment the level of TBHQ was in the range of 200–10,000 parts/million (ppm) and the level of citric acid ranged from 10 parts/million to 1,000 parts/million.

Furthermore, the oil is winterized in order to improve its pour point in cold temperatures. Table 3 shows the performance results of the selected oil (henceforth the base-oil) in the ASTM 2271. When compared with test oil (item #8, Table 2), the chemically modified soybean oil showed almost 50% improvement in its viscosity stability. The OSI results of the same oil was shown in Table 1, previously.

TABLE 3

The Selected Soybean Oil for Transformer and Transmission Line Cooling Oil

| Item # | Oil Type/ Description | Viscosity Initial | Viscosity Final | Viscosity % Change |
|---|---|---|---|---|
| 18 | Chemically Modified Soybean Oil (base oil) | 38.62 | 56.45 | 46.2 |

Once the optimal base-oil was identified, it was blended with various additive components and/or packages and tested for dielectric breakdown voltage using ASTM 877-87 tests method; *Dielectric Breakdown Voltage on Insulating Liquids Using Disk Electrodes.* The purpose was to determine the breakdown voltage for each oil; results are shown in Table 4.

TABLE 4

Dielectric Constants of Selected Soybean Oils.

| Oil Type | Dielectric Breakdown Voltage in kV |
|---|---|
| Crude Untreated Soybean Oil | 6.30 |
| Crude Soybean Oil + Antioxidants | 10.60 |
| Crude Soybean Oil with 20% Thinning Methyl Esters | 11.75 |
| Crude Soybean Oil with 20% Thinning Methyl Esters + Antioxidants | 16.20 |
| Modified* Soybean Oil | 16.89 |
| Modified* Soybean Oil + 20% Thinning Methyl Esters + Antioxidants | 14.25 |
| Modified* + 20% Thinning Methyl Esters | 19.20 |
| Modified* + Antioxidants | 23.95 |

*Modified: Chemically Modified (partially Hydrogenated) and Winterized.

The inclusion of methyl esters had to be with consideration to compatibility of soybean oil and methyl esters with seals and other elastomers used in transformers and transmission line cooling systems. Rubber compatibility tests requiring to immerse elastomer materials in test fluid for 72 hours at 100° C. and measuring expansion of the material indicated that the base oil had under 5% expansion while the thinning methyl ester fluid (when tested alone) has expansion as high as 46%. The blends identified present suitable dielectric values with under 10% expansion in elastomer compatibility tests.

The base oil, according to the preferred embodiment, presents the following characteristics:

| Characteristics: | |
|---|---|
| Appearance | Clear and brilliant at room temperature (observation) |
| Color | 1.0 red maximum (AOCS Cc 13b–45) |
| Peroxide Value | 1.00 meq/kg maximum (AOCS Cd 8–53) |
| Flavor and Odor | Bland (sensory evaluation) |
| Iodine Value | 100–120 |

-continued

| Chemical Composition: | |
|---|---|
| Palmitic | 7.4–10.2 |
| Stearic | 4.3–6.2 |
| Oleic | 35–48 |
| Linoleic | 34–54 |
| Linolenic | 3.5–8 |

The combination of the additive components with the specially prepared soybean oil blended with thinning esters has resulted in a synergy that is not common in other vegetable oil of unsaturated nature such as the soybean oil. The recognition of the synergy combined with an understanding that established test methods (used in literature) do not measure true performance of the vegetable oils in transformer and transmission line cooling system were essential in the development of this product. The established methods of evaluating the performance of electrically insulating fluid are designed for petroleum-based products, and are not always indicative of true performance of the vegetable oil based products.

Once the finished product was identified, it was used for field tests involving the facilities and transformer components of Waverly Light and Power, 1002 Adams Parkway, Waverly, Iowa 50677. Additionally, the oil when tested mechanically in a blended state 50/50 with petroleum-based oil showed similar stability performance. Test results indicated there was almost no difference in the change of viscosity in the test fluids during the comparative mechanical testing.

The tests with the blended soybean based oil and petroleum oil established that it is possible to retrofit the soybean base oil according to the present invention into existing electrical transformers or transmission lines. Even if some petroleum based oil remains after draining, it appears that it will have no affect on operation after it is refilled with the soybean based oil of the present invention.

At the conclusion of the various comparative analyses, it was determined that the combination of the chemical modification of the soybean oil and the addition of soybean-based esters and other chemical property enhancers provided superior results over the natural soybean oil or other vegetable oils. Use of the thinning esters with some of the antioxidants provided a synergy with the soybean oil, which enhanced the durability of the fluid far beyond what the existing arts indicated. Additionally, the additive produced positive results in the areas not directly related to the performance of the oil but to its environmental benefits such as biodegradability and toxicity.

Additional testing of the oil included biodegradability tests to determine the biodegradation of the mixture (fresh and after use in 1000-hour hydraulic pump test) in soil using $CO_2$ evolution in given number of days.

From the foregoing, it will be evident that the invention provides an improved non-petroleum based, environmentally safe electrically insulating fluid that can be commercially used in such components as transformers and transmission lines. The electrically insulating fluid of the invention utilizes soybean oil in which the soybean oil is less than 95% by weight of the fluid. The additive package used in the preferred embodiment contains materials specifically designed for transformer cooling applications. The combination of the specific soybean oil and the additive has produced an electrically insulating fluid that withstands the rigors of field use involving a wide range of temperatures. The preparation of the soybean oil-based electrically insulating fluid of the invention does not involve any heating with an outside heating source. Furthermore, the electrically insulating fluid of the invention has been designed to maintain a stable viscosity at a lower range of viscosity than those designed for possible use with other vegetable oils. The soybean oil based electrically insulating fluid of these examples is produced using an additional step of winterization to remove crystallized fats and improve the pour point of the base oil.

Having thus described the invention in connection with the preferred embodiments thereof, it will be evident to those skilled in the art that various modifications can be made to the preferred embodiments described herein without departing from the spirit and scope of the invention. It is our intention, however, that all such modifications that are evident to those skilled in the art will be included within the scope of the following claims.

It is believed that there may be, at times, condensation inside large electrical transformers, even though they are encased in metal and sealed. It is to be understood that other additives could be included with the electrically insulating fluid described herein to address further matters that may occur with such fluids. For example, an anti-sludge substance, such as is known in the art, could be added to combat any condensation. Another example is an anti-corrosion to deter acid interaction. These products are all available off the shelve and the amounts to be added are well within the skill of those of ordinary skill in the art.

The relative amounts of the various components of the composition described herein can vary. If the composition includes just base soybean oil (partially hydrogenated or made from high oleic content soybeans) and the antioxidant TBHQ, the ratio could be (by weight) from 99.98% base soybean oil and 0.02% TBHQ to 99% base soybean oil and 1% TBHQ. The preferred ratio is 99.5% base soybean oil and 0.5% TBHQ.

If a second antioxidant is added, such as citric acid, the ranges could be from 99.97% base soybean oil and 0.02% TBHQ and 0.01% citric acid, to 98.99% base soybean oil, and 1% TBHQ and 0.01% citric acid.

If thinning esters are utilized, they can comprise on the order of 0%–30% by weight of the fluid (depending upon desired viscosity), and alter the percentages of the base oil, and antioxidants accordingly.

The method of making the fluid comprises either processing commodity soybeans in conventional manners to produce soybean oil. The soybean oil is partially hydrogenated to a form similar to "salad quality oil" and winterized, both by known in the art methods. At least one antioxidant is added to the base soybean oil by mixing it in by known methods. A thinning ester can be blended in by known methods. The proportions can be such as are within the ranges expressed above. Alternatively, the beginning substance could be high oleic acid content soybean oil from genetically altered soybean plants. Hydrogenation may not be required if the oleic content is high enough. Winterization could still be performed and the antioxidant(s) mixed in. Thinning esters could be used to the extent needed or desired.

Electrical components, such as large transformers or fluid-filled transmission lines, such as are known in the art, can be constructed by building the component with a cavity or space(s) to hold an electrically insulating fluid. A fluid of the type described above could then be placed in the cavity or space.

Pour stabilizers for vegetable oils are available off-the-shelf for a variety of vendors and manufacturers. Examples are Viscoplex materials marketed by Rohmax Additives GmbH, Kirschenallee, D-64293 Darmstadt, Telephone +49 6151 18-09. can be used to improve pour point of the oil described herein. Specific examples are Viscoplex(R) 10-310 and 10-930. One form of product 10-310 is from the following chemical family: ester/rapeseed oil solution of a polymer on the bias of long-chain methacrylic acid esters and has the chemical name diethylhexyl adipate, CAS number 103-23-1; concentration 5–10%. These products effectively lower the pour point and stabilizes the pour point at least −25° C., and thus provide storage stability even under severe conditions. Typical addition rate: 0.5% wt for a storage stability at −25° C. It is biodegradable. Another form of product 10-310 is a solution of polyalkyl methacrylate (PAMA) in a biodegradable carrier oil.

As is well known in the art, an antioxidant is defined as follows—an organic compound added to rubber, natural fats and oils, food products, gasoline and lubricating oils to retard oxidation, deterioration, and rancidity. Rubber antioxidants are commonly of an aromatic amine type, such as di-beta-naphthyl-para-phenylenediamine and phenyl-beta-naphthylamine; a fraction of a percent affords adequate protection. The National Rubber Producers' Research Association has developed a technique for adding to a rubber mix organo-nitrogen compounds that are a converted during vulcanization to a powerful antioxidant that becomes part of the rubber molecule, making it impossible to wash out. Many antioxidants are substituted phenolic compounds. (butylated hydroxyanisole, di-tert-butyl-para-cresol, and propyl gallate). Food antioxidants are effective in very low concentrations (not more than 0.01% in animal fats) and not only retard rancidity but protect the nutritional value by minimizing the breakdown of vitamins and essential fatty acids. Sequestering agents, such as citric and phosphoric acids, are frequently employed in antioxidant mixtures to nullify the harmful effect of traces of metallic impurities. Note: Maximum concentration of food antioxidants approved by FDA is 0.02%.

Examples of other antioxidants are:

2,6,-di-tert-butyl-methylphenol;

2,4-dimethyl-6-tert-butylphenol;

N,N'-di-sec-butyl-para-phenylenediamine;

low-ash dioctyl diplenylamine;

N,N'-di-isopropyl-para-phenylenediamine;

high molecular weight hindered phenolic antioxidant;

N,N'-bis-(1,4-dimethylpentyl)-para-phenylenediamine;

high molecular weight, phenolic type antioxidant for polypropylene;

Antioxidant B™;

Antioxidant D™;

Butylated Hydroxyanisole;

Butylated Hydroxytoluene;

maleic acid BP [cis-Butenedioic acid $C_4H_4O_4$ 9116.07);

Taxilic acid;

Tocopherols (whether natural (some can occur in soybeans), generically enhanced or produced (e.g. in soybeans), or added).

Others are possible that function similarly with the base oil described herein.

What is claimed:

1. A high flash point insulating fluid for electrical components comprising:

an amount of base oil from a detectable amount to one-hundred percent comprising;

the base oil selected from the group consisting of at least partially hydrogenated soybean oil, soybean oil made from soybeans which are higher in oleic acid content relative to commodity soybeans, and combinations thereof;

and an antioxidant.

2. The fluid of claim 1 wherein the base oil comprises soybean oil made from soybeans which are higher in oleic acid content relative to commodity soybeans, comprise genetically-modified soybeans.

3. The fluid of claim 1 wherein the base oil comprises soybean oil from soybeans which are higher in oleic acid content relative to commodity soybeans, wherein the soybeans comprise bred soybeans.

4. The fluid of claim 1 wherein the amount of the selected base oil is fifty percent to less than one hundred percent of the fluid.

5. The fluid of claim 1 wherein the antioxidant comprises between 200 to 10,000 ppm of the fluid.

6. The fluid of claim 5 wherein the antioxidant produces an electrically insulating fluid having a kinematic viscosity in the range of 20–40 cSt as desired at 40° C. and it is a free radical scavenger.

7. The fluid of claim 1 wherein the base oil is winterized.

8. The fluid of claim 1 wherein the higher oleic acid content is on the order of 30% or more.

9. The fluid of claim 1 wherein the linolenic acid content of the base oil is on the order of less than or equal to 5%.

10. The fluid of claim 5 wherein the antioxidant is tertiary butylhydroquinone.

11. The fluid of claim 10 wherein the tertiary butylhydropquinone comprises between 200 ppm and 10,000 ppm of the fluid.

12. The fluid of claim 10 further comprising a second antioxidant.

13. The fluid of claim 12 wherein the second antioxidant comprises citric acid.

14. The fluid of claim 13 wherein the citric acid comprises in the range of 10 to 1000 ppm and the tertiary butylhydroquinone comprises in the range of 200 to 10,000 ppm.

15. The fluid of claim 1 further comprising a thinning agent blended into the fluid.

16. The fluid of claim 15 wherein the thinning agent comprises thinning esters.

17. The fluid of claim 16 wherein the thinning esters comprise methyl esters in the range of carbon chain lengths of 16 to 18.

18. The fluid of claim 17 wherein the methyl esters comprise approximately 0% to 30% by weight of the fluid based on desired viscosity.

19. A high fire point insulating fluid for electrical components comprising:

an amount of base oil from a detectable amount to one hundred percent comprising:

a base oil selected from the group consisting of at least partially hydrogenated soybean oil, soybean oil made from soybeans which are higher in oleic acid content relative to commodity soybeans, and combinations thereof;

an antioxidant.

20. The fluid of claim 19 wherein the base oil comprises soybean oil made from soybeans which are higher in oleic acid content relative to commodity soybeans, comprise genetically-modified soybeans.

21. The fluid of claim 19 wherein the base oil comprises soybean oil from soybeans which are higher in oleic acid content relative to commodity soybeans, wherein the soybeans comprise bred soybeans.

22. The fluid of claim 19 wherein the amount of the selected base oil is fifty percent to one hundred percent.

23. The fluid of claim 19 further wherein the antioxidant comprises between 200 to 10,000 ppm of the fluid.

24. The fluid of claim 23 further wherein the antioxidant produces an electrically insulating fluid having a kinematic viscosity in the range of 20–40 cSt as desired at 40° C. and it is a free radical scavenger.

25. The fluid of claim 19 wherein the base oil is winterized.

26. The fluid of claim 19 where in the higher oleic acid content is on the order of 30% or more.

27. The fluid of claim 19 wherein the linolenic acid content of the base oil is on the order of less than or 5%.

28. The fluid of claim 19 wherein the antioxidant is tertiary butylhydroquinone.

29. The fluid of claim 28 wherein the tertiary butylhydroquinone comprises between 200 ppm and 10,000 ppm of the fluid.

30. The fluid of claim 28 further comprising a second antioxidant.

31. The fluid of claim 30 wherein the second antioxidant comprises citric acid.

32. The fluid of claim 31 wherein the citric acid comprises in the range of 10 to 1000 ppm and the tertiary butylhydroquinone comprises in the range of 200 to 10,000 ppm.

33. The fluid of claim 19 further comprising a thinning agent blended into the fluid.

34. The fluid of claim 33 wherein the thinning agent comprises thinning esters.

35. The fluid of claim 34 wherein the thinning esters comprise methyl esters in the range of carbon chain lengths of 16 to 18.

36. The fluid of claim 35 wherein the methyl esters comprise approximately 0% to 30% by weight of the fluid based on desired viscosity.

37. A method of obtaining a high flash point of the insulating fluid in an electrical component comprising:

creating an electrically insulating fluid comprising:

an amount of base oil from a detectable amount to one hundred percent comprising a base oil selected from the group consisting of at least partially hydrogenated soybean oil, soybean oil made from soybeans which are higher in oleic acid content relative to commodity soybeans, and combinations thereof;

and an antioxidant; and placing the fluid into the electrical component.

38. The method of claim 37 wherein the base oil comprises soybean oil made from soybeans which are higher in oleic acid content relative to commodity soybeans, comprise genetically-modified soybeans.

39. The method of claim 37 wherein the base oil comprises soybean oil made from soybeans which higher in oleic acid content relative to commodity soybeans, wherein the soybeans comprise bred soybeans.

40. The method of claim 37 wherein the amount of the selected base oil is fifty percent to one hundred percent.

41. The method of claim 37 wherein the electrical component is an electrical transformer.

42. The method of claim 41 wherein the electrical transformer is a electric utility transmission and distribution transformer.

43. The method of claim 37 wherein the electrical component is a fluid-filled electrical transmission cable.

44. The method of claim 37 wherein the base oil is made from commodity soybeans which are partially hydrogenated.

45. The method of claim 37 further comprising draining petroleum based oil from the electrical component before placing the fluid into the electrical component.

46. The method of claim 37 wherein the antioxidant comprises from 0.02% to 1.0% by weight of the fluid.

47. The method of claim 37 wherein the base oil is made from genetically engineered soybeans that are high in oleic acid content relative to commodity soybeans.

48. The method of claim 37 wherein the soybean oil is winterized.

49. The method of claim 37 wherein the viscosity of the fluid is adjusted by blending a thinning substance into the fluid.

50. A method of obtaining a high fire point of the insulating fluid in an electrical component comprising:

creating an electrically insulating fluid comprising:

an amount of base oil from a detectable amount to one hundred percent comprising a based oil selected from the group consisting of at least partially hydrogenated soybean oil, soybean oil made from soybeans which are higher in oleic acid content relative to commodity soybeans, and combinations thereof;

and an antioxidant; and placing the fluid into the electrical component.

51. The method of claim 50 wherein the base oil comprises a soybean oil made from soybeans which are higher in oleic acid content relative to commodity soybeans, comprise genetically-modified soybeans.

52. The method of claim 50 wherein the base oil comprises soybean oil made from soybeans which higher in oleic acid content relative to commodity soybeans, wherein the soybeans comprise bred soybeans.

53. The method of claim 50 wherein the amount of the selected base oil is greater than fifty percent to one hundred percent.

54. The method of claim 50 wherein the electrical component is an electrical transformer.

55. The method of claim 54 wherein the electrical transformer is a electric utility transmission and distribution transformer.

56. The method of claim 50 wherein the electrical component is a fluid-filled electrical transmission cable.

57. The method of claim 50 wherein the base oil is made from commodity soybeans which are partially hydrogenated.

58. The method of claim 50 further comprising draining petroleum based fluid from the electrical component before placing the fluid into the electrical component.

59. The method of claim 50 further comprising draining silicone based fluid from the electrical component before placing the fluid into the electrical component.

60. The method of claim 50 wherein the antioxidant comprises from 0.02% to 1.0% by weight of the base oil.

61. The method of claim 50 wherein the base oil is made from genetically engineered soybeans that are high in oleic acid content relative to commodity soybeans.

62. The method of claim 58 wherein the base oil is winterized.

63. The method of claim 58 wherein the viscosity of the fluid is adjusted by blending a thinning substance into the fluid.

64. A process for producing a soybean oil-based electrically insulating fluid with a high flash point comprising selecting an amount of base oil from a detectable amount to one hundred percent comprising; a base oil comprising stabilized soybean oil wherein the soybean oil is stabilized by hydrogenating the soybean oil or using soybean oil made from soybeans which are higher in oleic acid relative to commodity soybean oil;

winterizing the stabilized soybean oil to remove crystallized fats and reduce pour point; and combining the soybean oil with a thinning ester and an antioxidant to produce an electrically insulating fluid having a kinematic viscosity in the range of 20–40 cSt at 40° C.

65. The process of claim 64 for producing a soybean oil based electrically insulating fluid in which the soybean oil is less than 95 to 99.98% by weight of the fluid.

66. The process of claim 64 for producing a soybean oil based electrically insulating fluid which is about 95% by weight soybean oil and about 0.5% by weight antioxidant.

67. The process of claim 64 for producing a soybean oil based electrically insulating fluid in which the fatty acid profile of the electrically insulating fluid includes a small amount of C24:0.

68. The process of claim 64 wherein the the antioxidant comprises about 01%–1% of the total weight of the base oil citric acid, about 0.05%–0.5% of the total weight of the base and about 0.05%–0.5% of the total weight of the tocopherols wherein the tocopherols occur naturally in the soybeans, are genetically enhanced in the soybeans, or is additive.

69. The process of claim 64 wherein the thinning esters comprise 0% to 30% by weight of the total weight of the base oil.

70. A soybean oil based electrically insulating fluid produced by the process of claim 64 comprised of about 95% to 99.98% by weight soybean oil and about 0.02% to 5% by weight non-petroleum-based performance additives.

71. A high flash point electrical component comprising:

a body, the body including a cavity for an electrically insulating fluid; and an electrically insulating fluid in the cavity comprising:

an amount of a base oil from a detectable amount to one hundred percent comprising a base oil selected from the group consisting of at least partially hydrogenated soybean oil, soybean oil made from soybeans which are higher in oleic acid content relative to commodity soybean oil, and combinations thereof;

and an antioxidant.

72. The component of claim 71 wherein the base oil comprises soybean oil made from soybeans which are higher in oleic acid content relative to commodity soybean oil, wherein the soybeans comprise genetically-modified soybeans.

73. The component of claim 71 wherein the base oil comprises soybean oil made from soybeans which are higher in oleic acid content than commodity soybean oil, wherein the soybeans comprise bred soybeans.

74. The component of claim 71 wherein the amount of the selected base oil comprises fifty percent to one hundred percent.

75. The component of claim 71 wherein the component comprises an electrical transformer.

76. The component of claim 71 wherein the component comprises a fluid-filled electrical transmission cable.

77. The component of claim 71 wherein the fluid is winterized produces a high flash point fluid having a kinematic viscosity in the range of 20–40 cSt at 40° C.

78. The component of claim 71 wherein the fluid further comprising a thinning agent.

79. The component of claim 78 wherein the agent is selected from the group consisting of a thinning ester derived from soybean oil, thinning ester derived from palm oil, thinning ester derived from coconut oil, and alcohol.

80. The component of claim 78 wherein the thinning agent comprises from 0% to 30% by weight of the fluid.

81. The component of claim 71 wherein the base oil comprises partially hydrogenated or fully hydrogenated soybean oil and the level of hydrogenation is on the order of salad quality oil.

82. The component of claim 71 wherein the base oil comprises partially hydrogenated or fully hydrogenated soybean oil and the level of hydrogenation has an Iodine Value of approximately in the range of 100–120.

83. A high fire point electrical component comprising:

a body, the body including a cavity for an electrically insulating fluid; and an electrically insulating fluid in the cavity comprising an amount of a base oil from a detectable amount to one hundred percent comprising a base oil selected from the group consisting of at least partially hydrogenated soybean oil, soybean oil made from soybeans which are higher in oleic acid content relative to commodity soybean oil, and combinations thereof; and an antioxidant.

84. The component of claim 83 wherein the base oil comprises soybean oil made from soybeans which are higher in oleic acid content relative to commodity soybean oil, wherein the soybeans comprise genetically-modified soybeans.

85. The component of claim 83 wherein the base oil comprises soybean oil made from soybeans which are higher in oleic acid content relative to commodity soybean oil comprise bred soybeans.

86. The component of claim 83 wherein the amount of the selected base oil comprises fifty percent to one hundred percent.

87. The component of claim 83 wherein the component comprises an electrical transformer.

88. The component of claim 83 wherein the component comprises a fluid-filled electrical transmission cable.

89. The component of claim 83 wherein the fluid is winterized produces a high flash point fluid having a kinematic viscosity in the range of 20–40 cSt at 40° C.

90. The component of claim 83 wherein the fluid further comprises a thinning agent.

91. The component of claim 90 wherein the thinning agent is selected from the group consisting of a thinning ester derived from soybean oil, thinning ester derived from palm oil, thinning ester derived from coconut oil, and alcohol.

92. The component of claim 90 wherein the thinning agent comprises from 0% to 30% by weight of the fluid.

93. The component of claim 83 wherein the hydrogenation of the fluid is on the order of salad quality oil.

94. The component of claim 83 wherein the hydrogenation of the fluid has an Iodine Value of approximately in the range of 100–120.

* * * * *

UNITED STATES PATENT AND TRADEMARK OFFICE

CERTIFICATE OF CORRECTION

PATENT NO. : 6,245,726 B1
DATED : June 12, 2001
INVENTOR(S) : Cannon et al.

It is certified that error appears in the above-identified patent and that said Letters Patent is hereby corrected as shown below:

Column 12, claim 11,
Line 31, please delete [butylhydropquinone] and insert -- butylhydroquinone --.

Column 13, claim 39,
Line 53, please insert -- are -- between "which higher".

Column 15, claim 68,
Line 19, please delete [01%] and insert -- 0.01% --.
Line 21, please insert before "and" at the beginning of the line -- oil TBHQ -- and insert -- base oil -- before "tocopherols".
Line 23, please insert -- an -- before "additive".

Column 15, claim 78,
Line 63, please delete [comprising] and insert -- comprises --.

Signed and Sealed this

Second Day of April, 2002

*Attest:*

*Attesting Officer*

JAMES E. ROGAN
*Director of the United States Patent and Trademark Office*